US009413116B1

(12) United States Patent
Villasenor et al.

(10) Patent No.: US 9,413,116 B1
(45) Date of Patent: Aug. 9, 2016

(54) SLOTTED, CLAMPED TERMINATION RING FOR AN ELECTRICAL CONNECTOR ASSEMBLY

(71) Applicant: Glenair, Inc., Glendale, CA (US)

(72) Inventors: Pedro L. Villasenor, Templeton, CA (US); James G. Plessas, San Luis Obispo, CA (US); Zachary W. Taylor, Paso Robles, CA (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 14/817,136

(22) Filed: Aug. 3, 2015

(51) Int. Cl.
*H01R 13/58* (2006.01)
*H01R 13/6581* (2011.01)
*H01R 43/16* (2006.01)

(52) U.S. Cl.
CPC ..... *H01R 13/6581* (2013.01); *H01R 13/5812* (2013.01); *H01R 43/16* (2013.01)

(58) Field of Classification Search
CPC ..... H01R 13/5804; H01R 13/5812; H01R 13/6581; H01R 43/16
USPC ..... 439/320, 321, 470, 471, 607.27
See application file for complete search history.

(56) References Cited

U.S. PATENT DOCUMENTS

| | | | | |
|---|---|---|---|---|
| 6,276,967 | B1 | 8/2001 | Hall | |
| 6,375,509 | B2 * | 4/2002 | Mountford | H01R 13/6599 439/321 |
| 6,419,519 | B1 | 7/2002 | Young | |
| 7,044,795 | B2 * | 5/2006 | Diep | H01R 13/582 439/471 |
| 7,419,402 | B2 * | 9/2008 | Carnahan | H01R 13/5841 439/470 |

* cited by examiner

*Primary Examiner* — Khiem Nguyen
(74) *Attorney, Agent, or Firm* — David S. Alavi

(57) ABSTRACT

A termination ring for an electrical connector has slots for receiving multiple inner conductive shields of a cable. The shields pass through the slots, are folded back onto a rear portion of the termination ring, and are clamped onto the termination ring. After assembling a backshell onto the connector over the termination ring, a void remains between the interior surface of the backshell and the clamped inner conductive shields, thereby enabling proper mechanical engagement of the connector, termination ring, and backshell.

34 Claims, 16 Drawing Sheets

100
106
120b
114
120a
108
108
112
120b
120a
105

100
114
120b
105
3E
106
105
3E
112
114
100
106
120b
120b
114
105
120a
112

114
106
105
100
108
114
120

112
120
108
105
100

SLOTTED, CLAMPED TERMINATION RING FOR AN ELECTRICAL CONNECTOR ASSEMBLY

FIELD OF THE INVENTION

The field of the present invention relates to electrical connector assemblies. In particular, a slotted, clamped termination ring for an electrical connector assembly and methods for its incorporation into the connector assembly are disclosed.

BACKGROUND

Some examples of electrical connector assemblies with termination rings are disclosed in:

U.S. Pat. No. 6,276,967 entitled "Shield termination connector assembly and method for using the same" issued Aug. 21, 2001 to Hall; and U.S. Pat. No. 6,419,519 entitled "Strain relief for electrical connectors" issued Jul. 16, 2002 to Young.

The electrical connector disclosed in U.S. Pat. No. 6,419,519 issued to Young includes a conductive termination ring positioned between a front connector body and a rear connector body. The front connector body is sometimes simply referred to as "the connector," while the rear connector body is also known in the industry as a connector accessory or as a backshell adapter assembly (or simply "backshell"). When the connector is installed on an electrical cable (to facilitate connection of the cable to a device or to another cable, using a mating connector or receptacle), the termination ring of Young serves as a mechanical attachment for a conductive outer shield of the cable and provides electrical continuity between the cable outer shield and the front connector body upon assembly of the connector.

The electrical connector disclosed in U.S. Pat. No. 6,276,967 issued to Hall includes a slotted termination ring that serves as a mechanical attachment for multiple individual shields of multiple wires within a cable. Those shields are compressed between the termination ring and the conductive backshell to provide mechanical attachment and electrical continuity between the multiple individual shields and the backshell upon assembly of the connector.

SUMMARY

An inventive method can be employed for terminating an electrical cable with an electrical connector assembly including a termination ring and a clamp. A forward end of the cable is inserted through a backshell assembly of the connector assembly and through the central passage of the termination ring. An outer jacket of the cable is stripped from a forward end of the cable, and the wires and inner conductive shields are separated from one another at the forward end of the cable. A corresponding conductive contact is attached to a forward end of each wire, and the contacts are installed into a front connector body of the connector assembly.

The termination ring includes one or more slots extending from the outer surface through the termination ring to the central passage and extending rearward from a forward end of the termination ring. Each inner conductive shield is passed through a corresponding one of the slots of the termination ring, and the termination ring is moved forward along the wires and inner conductive shields to non-rotatably engage the front connector body. The inner conductive shields are folded back onto the rearward portion of the outer surface of the termination ring, and the folded-back portions are secured against the outer surface with the clamp. The backshell assembly is moved forward along the cable to non-rotatably engage the termination ring and secured to the front connector body with the termination ring therebetween. A void remains between (i) the interior lateral surface of the backshell assembly and (ii) the folded-back portions of the inner conductive shields retained by the clamp against the rearward portion of the outer surface. In some instances, the rearward portion of the outer surface of the termination ring can have a diameter that is smaller than that of a forward portion of the outer surface; in such instances, each one of the slots extends rearward at least to the rearward portion of the outer surface.

In some instances, after assembly of the electrical connector assembly onto the electrical cable, the backshell assembly can be released from the front connector body and moved rearward along the cable, thereby enabling one or more among (i) the one or more wires, (ii) the corresponding conductive contacts, or (iii) the one or more inner conductive shields to be disconnected, repaired, replaced, or reconnected. Afterward, the backshell assembly can be moved forward along the cable to non-rotatably engage the termination ring and re-secured to the front connector body with the termination ring therebetween. The void remains between (i) the interior lateral surface of the backshell assembly and (ii) the folded-back portions of the inner conductive shields retained by the clamp against the rearward portion of the outer surface.

An inventive article can comprise the electrically conductive termination ring, the circumferential clamp, and the backshell assembly. Another inventive article can comprise the termination ring and the clamp, wherein the diameter of the rearward portion of the termination is smaller than that of the forward portion of the outer surface.

Objects and advantages pertaining to electrical connector assemblies may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims.

DETAILED DESCRIPTION OF EMBODIMENTS

Some electrical cables include multiple insulated electrical wires enclosed within a single outer conductive shield of a cable. That single outer conductive shield (in the form of, e.g., tubular metal braid, tubular metal foil, or other suitable type or arrangement) encloses all of the multiple insulated electrical wires that make up the cable. Some multiple-wire electrical cables include, instead of or in addition to an outer conductive shield, one or more inner conductive shields. In one example, a cable can comprise multiple twisted pairs of insulated electrical wires, and each twisted pair can be enclosed in its own inner conductive shield (again, in the form of, e.g., metal braid, metal foil, or other suitable type or arrangement). All of the individually shielded pairs also can be enclosed in a single outer conductive shield of any suitable type or arrangement, if needed or desired.

Figure 1A:
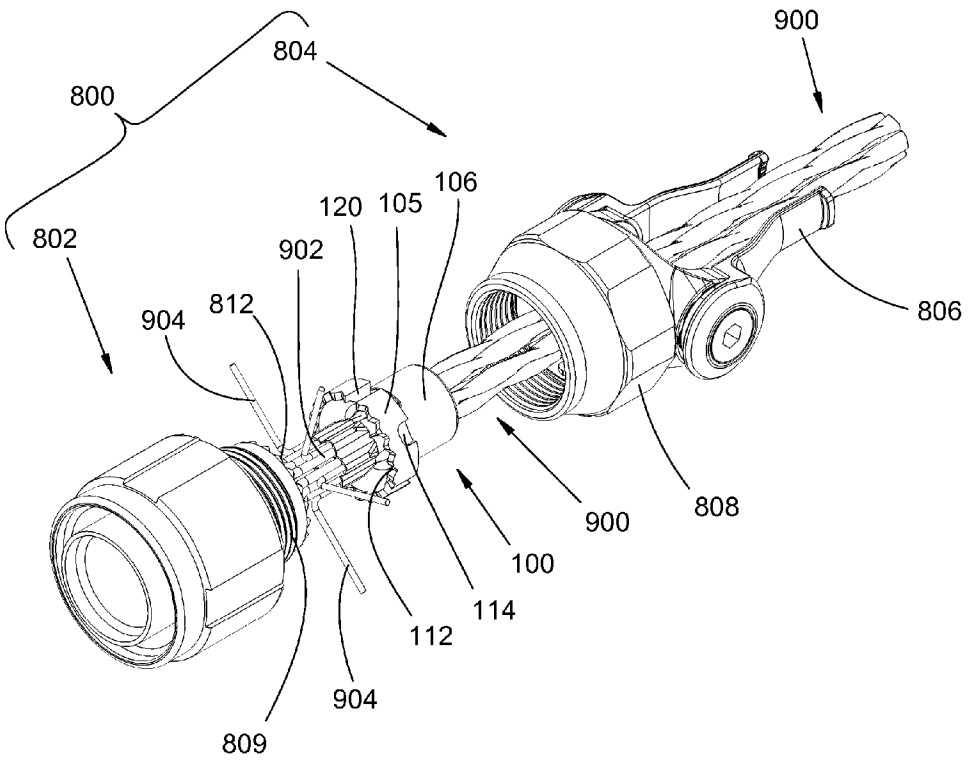
FIGS. 1A through 1E illustrate an example of an inventive assembly sequence for an electrical connector including a termination ring and a clamp.
Figure 1B:
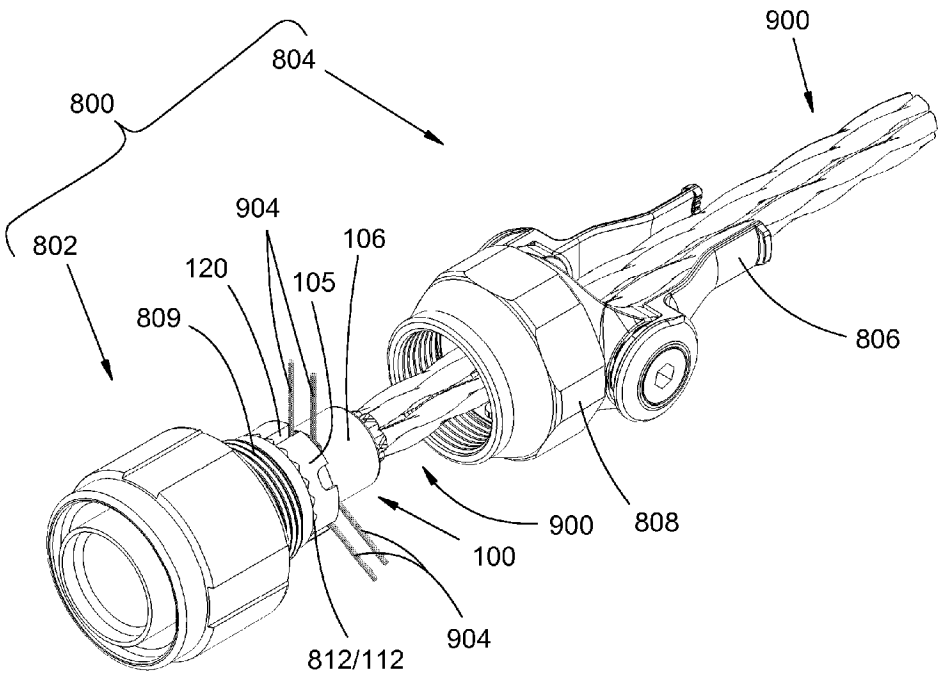
Figure 1C:
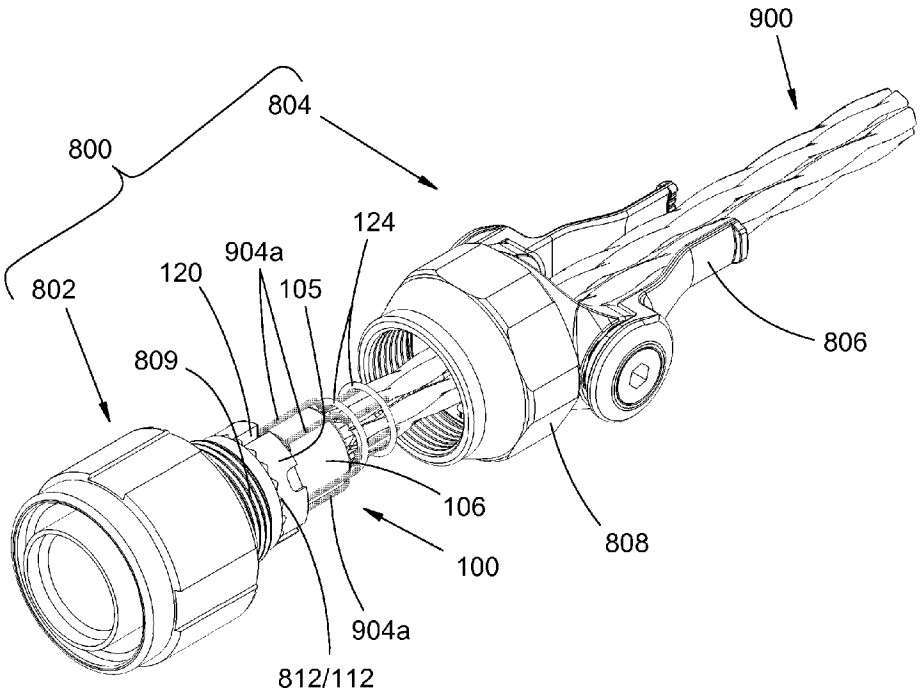
Figure 1D:
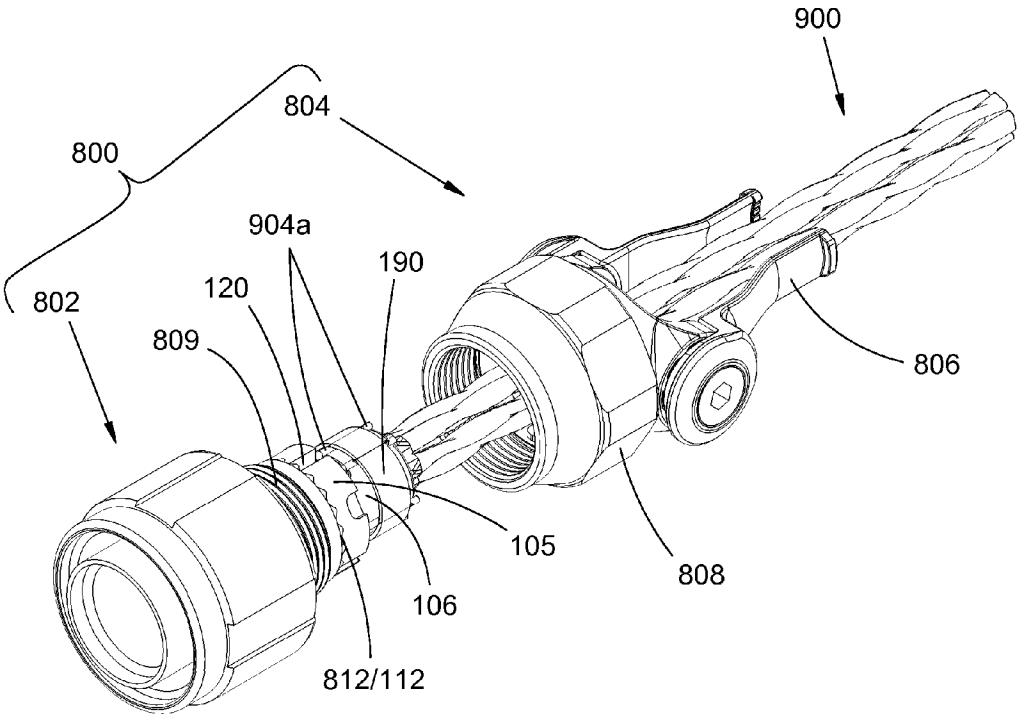
Figure 1E:
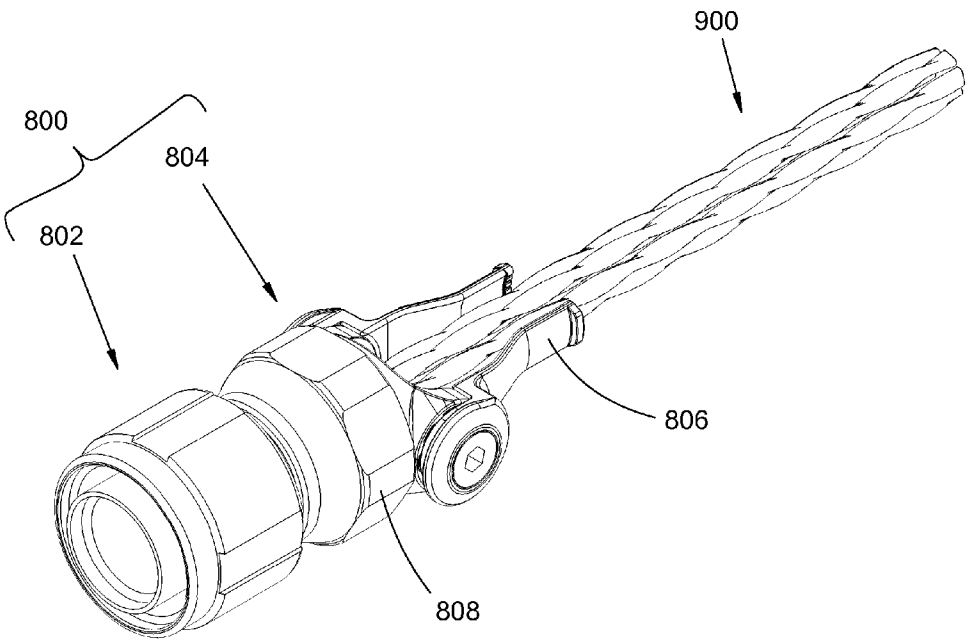
Figure 1F:
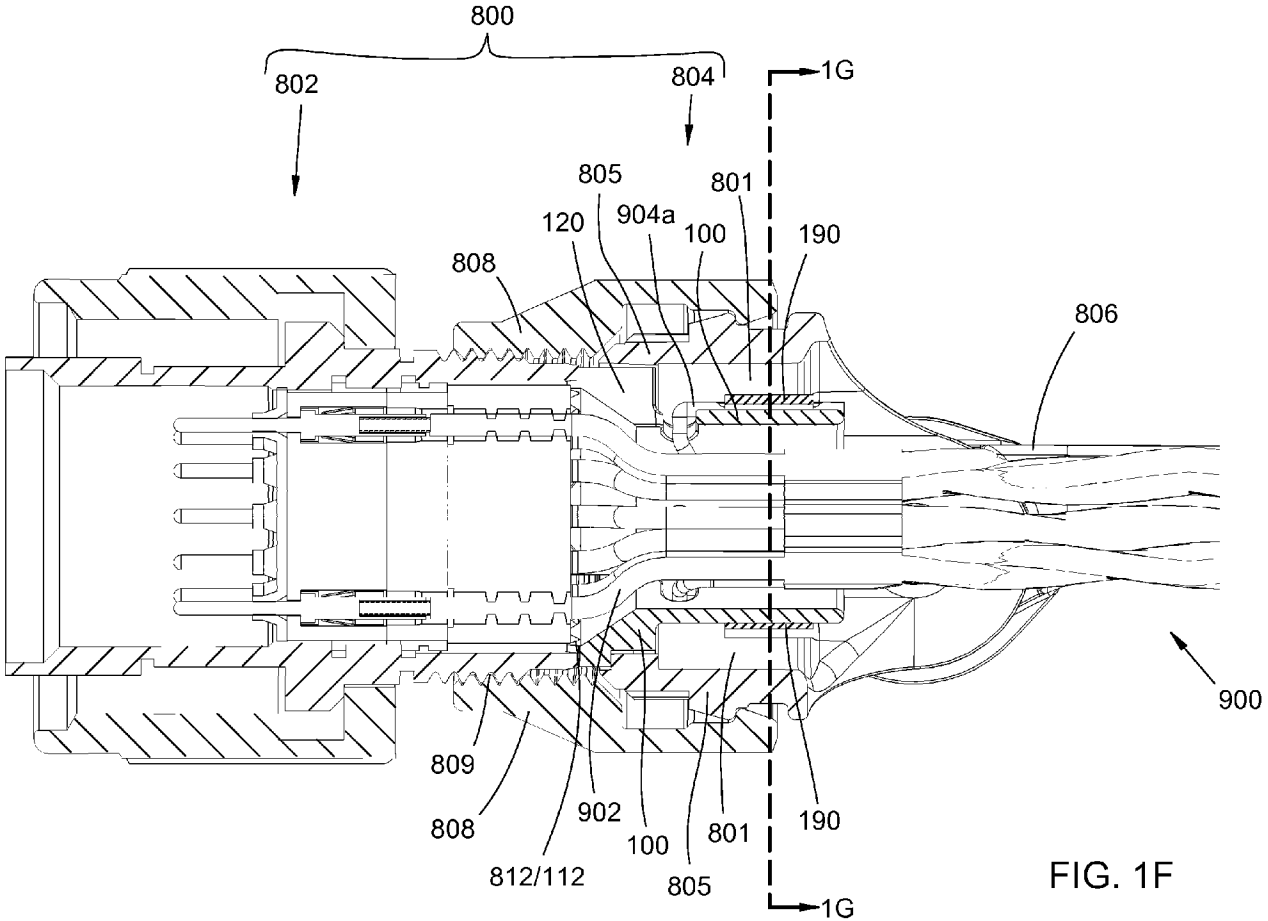
FIGS. 1F and 1G are longitudinal and transverse cross sections, respectively, of the assembled electrical assembly.
Figure 1G:
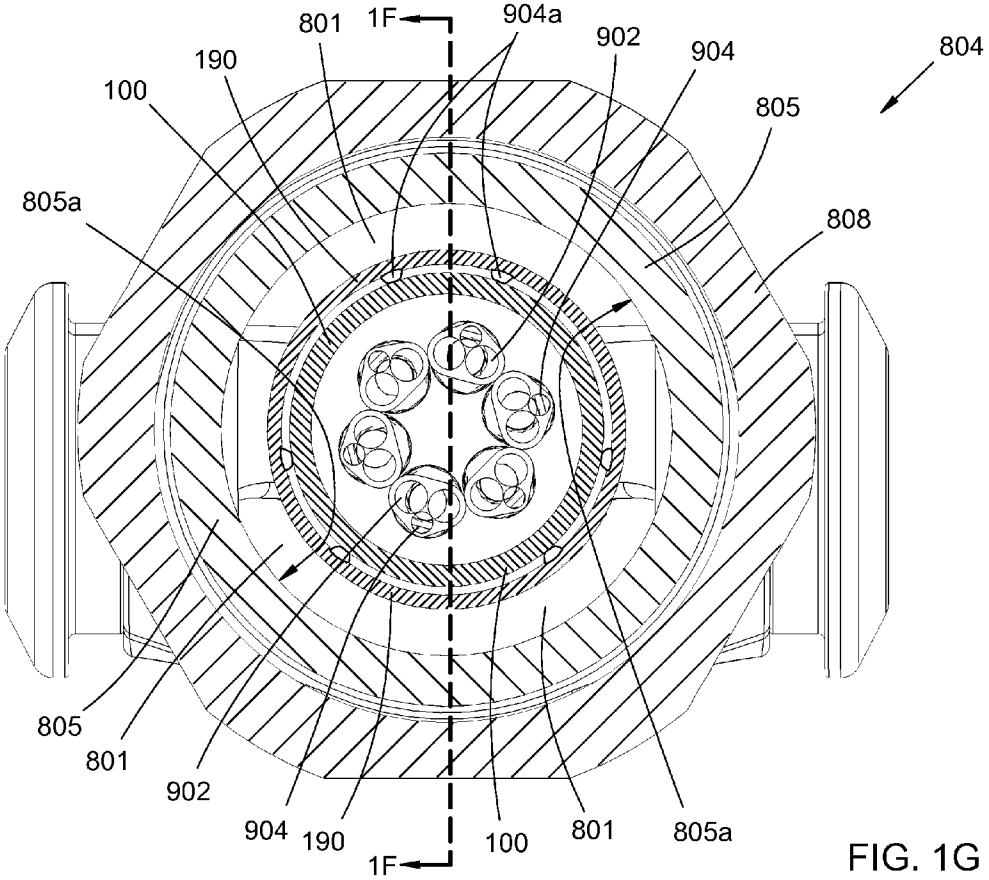
Figure 2A:
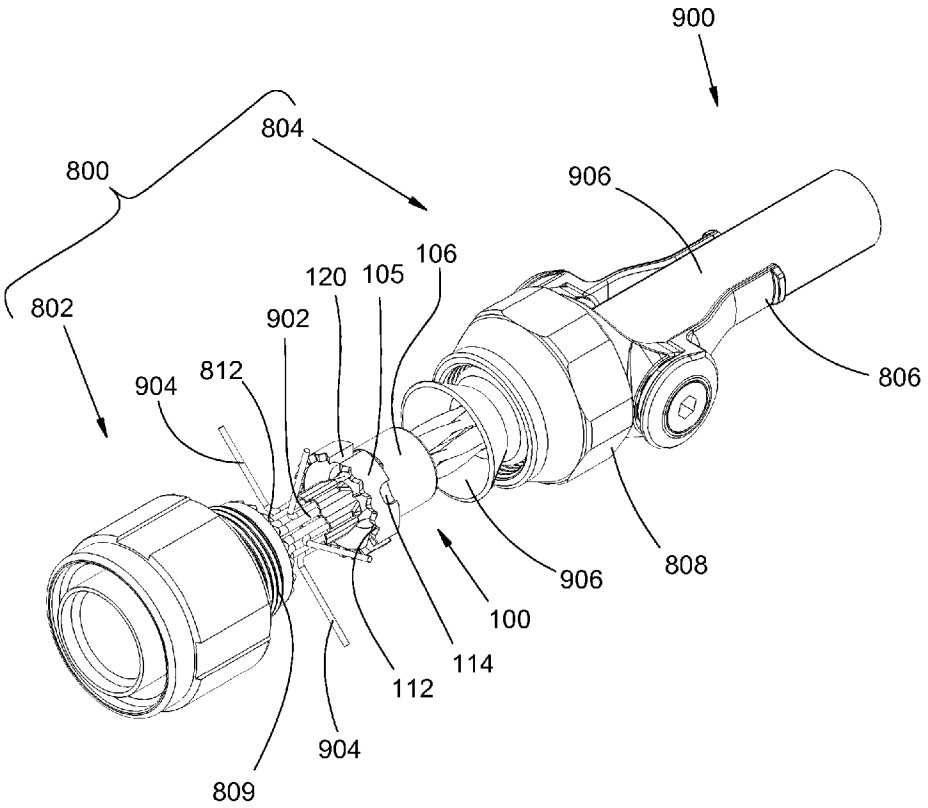
FIGS. 2A through 2E illustrate another example of an inventive assembly sequence for an electrical connector including a termination ring and a clamp.
Figure 2B:
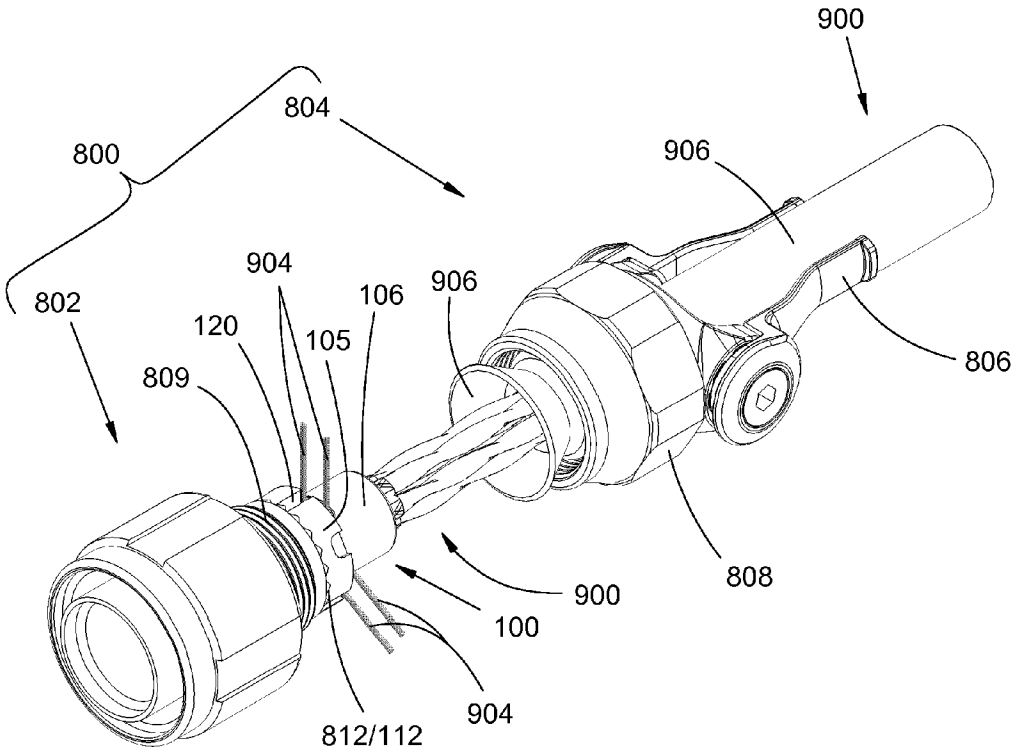
Figure 2C:
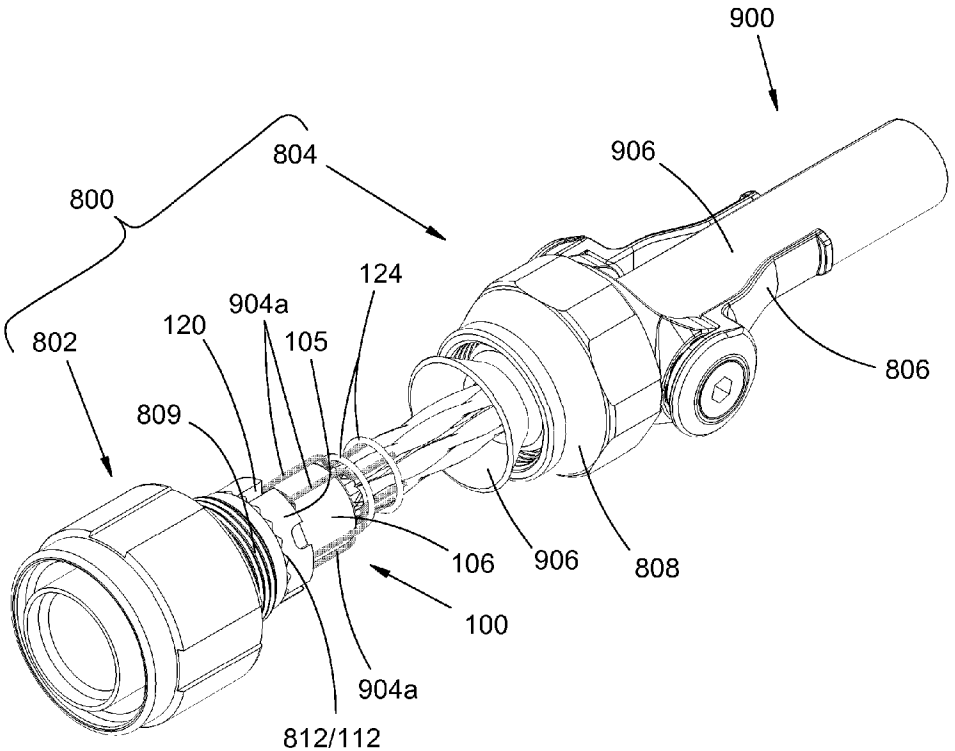
Figure 2D:
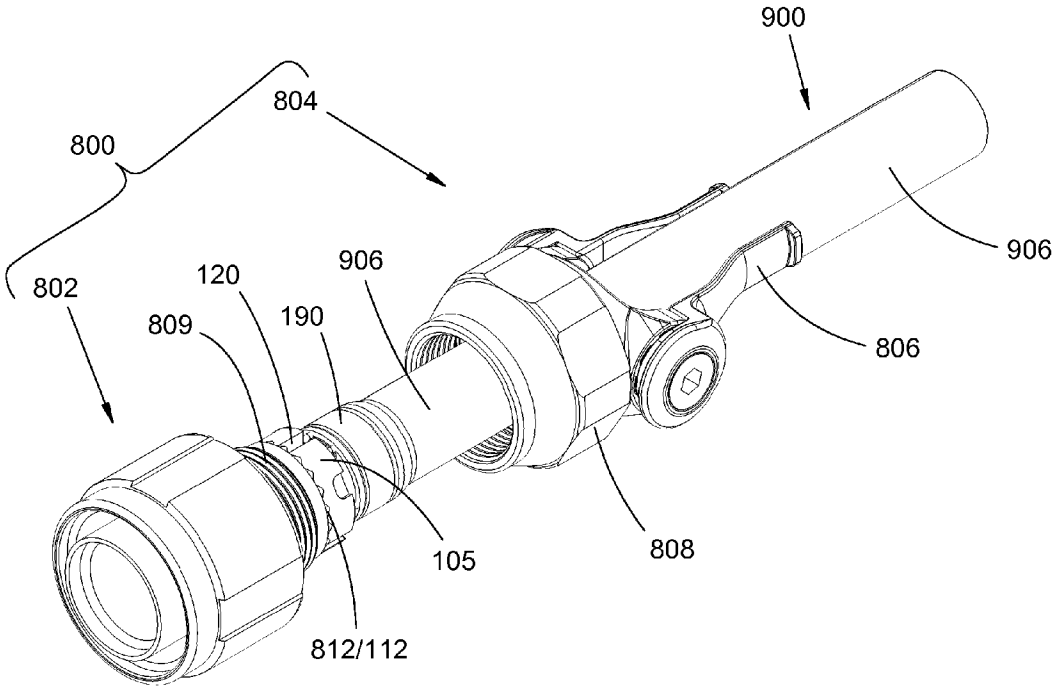
Figure 2E:
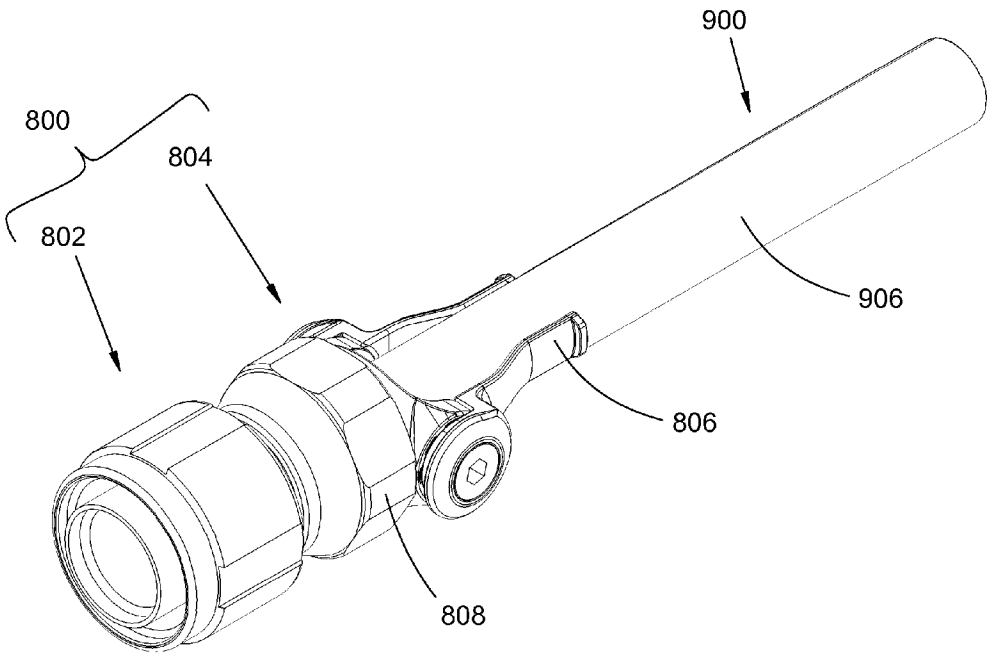
Figure 2F:
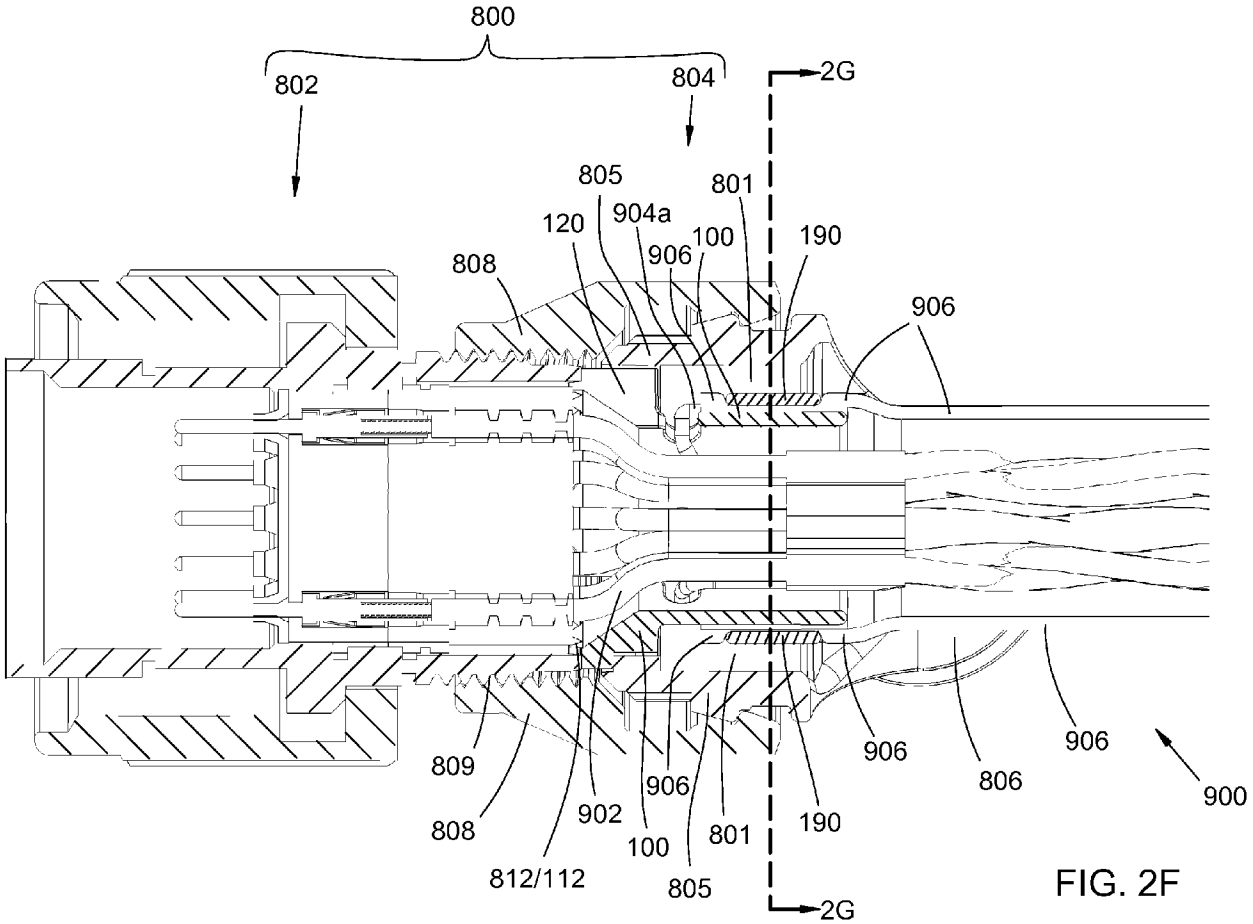
FIGS. 2F and 2G are longitudinal and transverse cross sections, respectively, of the assembled electrical assembly.
Figure 2G:
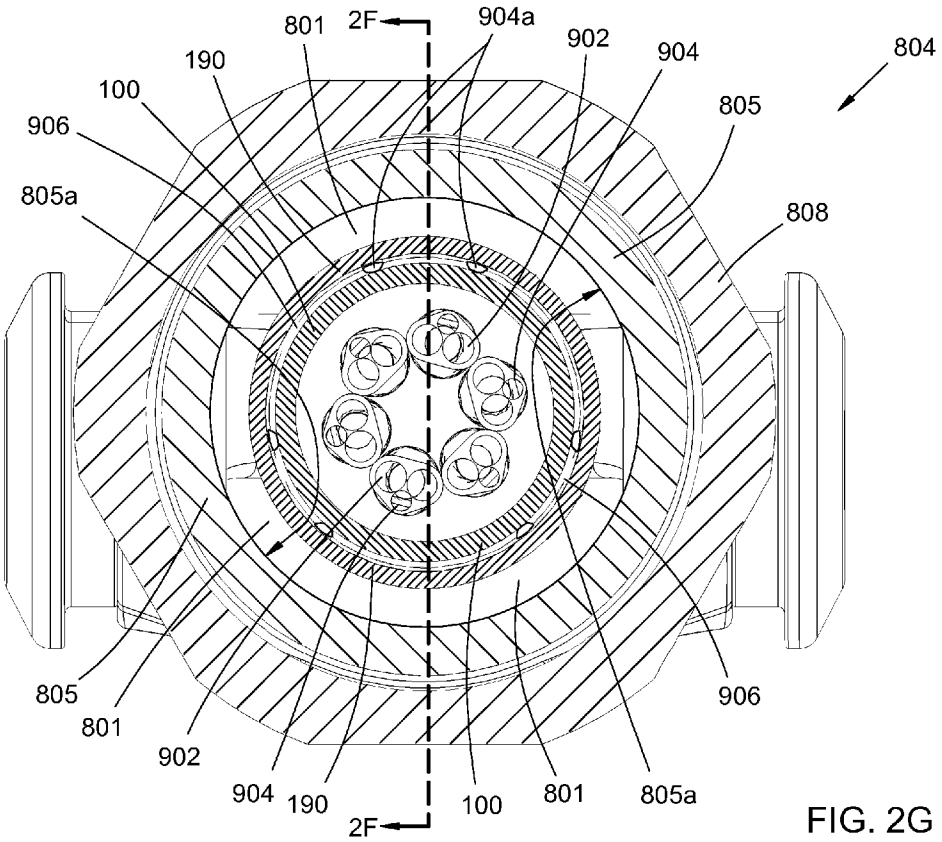

Examples of inventive assembly procedures for terminating an electrical cable 900 with an electrical connector assembly 800 incorporating the termination ring 100 and the clamp 190 are illustrated in FIGS. 1A through 1G and FIGS. 2A through 2G. In the examples shown, the cable 900 comprises six twisted pairs of insulated electrical wires 902, each with a corresponding inner conductive shield 904; other suitable numbers of wires 902 or inner shields 904 can be employed. In the example of FIGS. 2A through 2G, an optional outer conductive shield 906 surrounds all of the wires 902 and inner conductive shields 904. An outer jacket that encloses all of the wires 902 and inner conductive shields 904 (and the outer conductive shield 906, if present) has been omitted from the drawings for clarity. The connector assembly 800 comprises a front connector body 802, a backshell assembly 804, a termination ring 100, and a clamp 190. The front connector body 802 and the backshell assembly 804 can assume any suitable form or arrangement, including customer-specified arrangements or arrangements conforming to an industry specification or standard (e.g., MIL specifications or SAE standards). In the example shown, the front connector body 802 is arranged according to an SAE AS85049 standard, and the backshell assembly 804 includes a backshell body 805, a nut 808, and a swing arm 806 for supporting the cable 900 in a fixed orientation relative to the connector assembly 800; other examples of a backshell assembly can include conduit assemblies or fixed-arm assemblies. In some examples, the backshell assembly 804 can comprise one or more conductive materials; in other examples the backshell assembly 804 can comprise one or more insulating materials. For purposes of the present disclosure and appended claims, directional terms such a front, forward, rear, rearward, and so forth are defined relative to the connector assembly 800, with "front" and the like being the direction from the connector assembly toward a mating connector assembly, and "rear" and the like being the opposite direction, i.e., toward the cable 900 connected to the connector assembly 800. Any motion or movement recited in the disclosure, examples, or claims are relative motions or movements, e.g., forward movement of the cable 900 toward the connector assembly 800 is equivalent to rearward movement of the connector assembly 800 toward the cable 900.

Figures 3A, 3B, 3C, 3D, 3E:
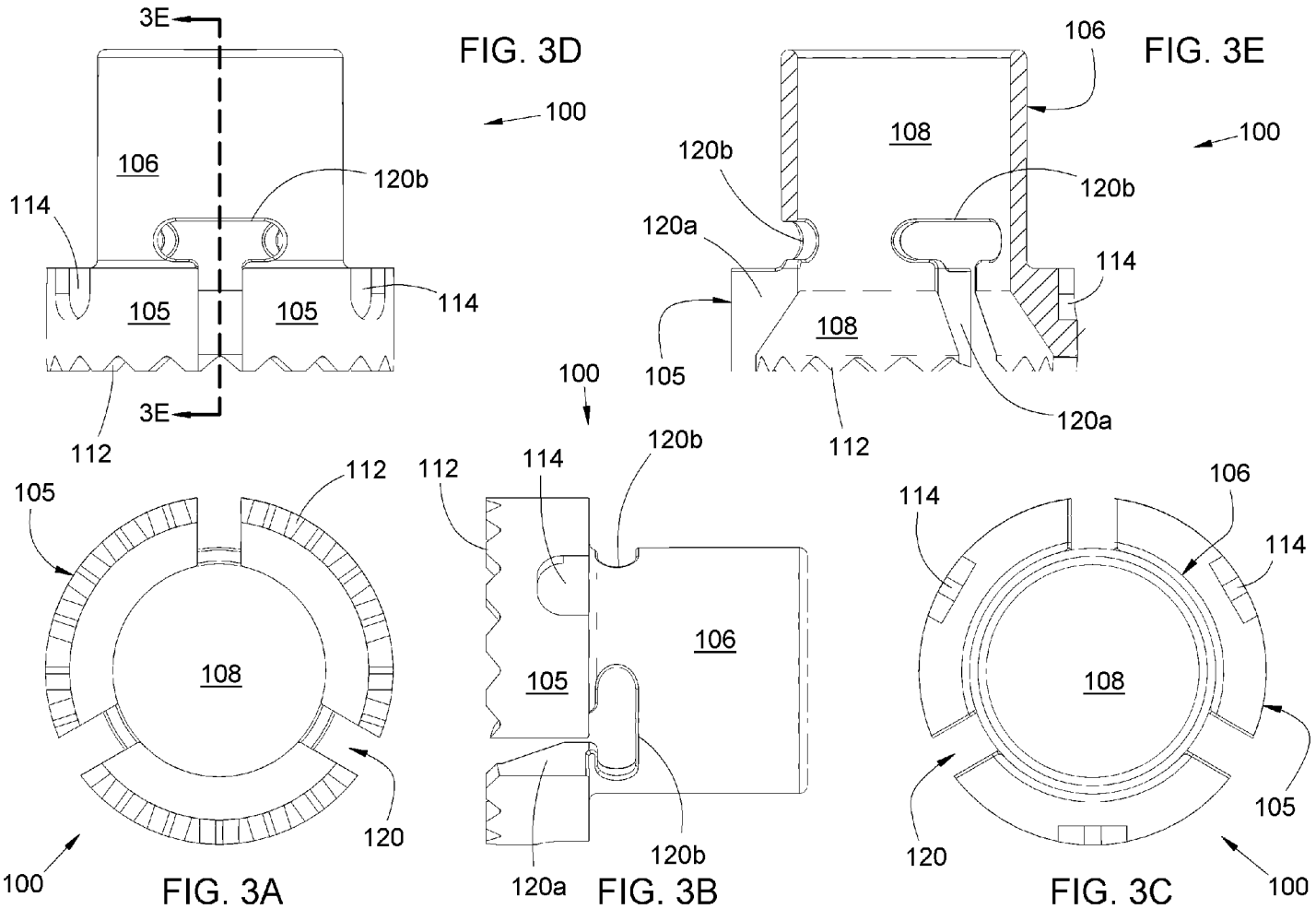
FIGS. 3A through 3G are front, side, rear, top, longitudinal cross-sectional, front perspective, and rear perspective views, respectively, of an inventive termination ring.
Figure 3G:
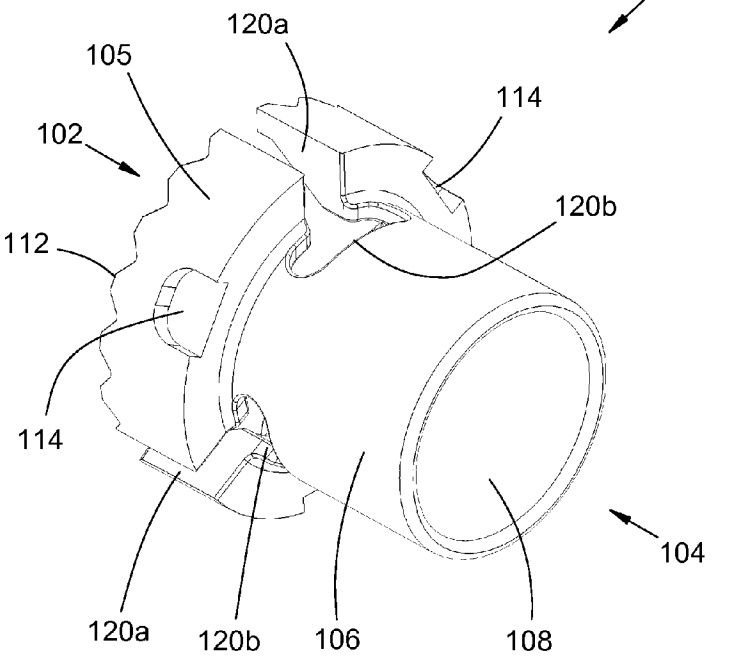
Figure 3F:
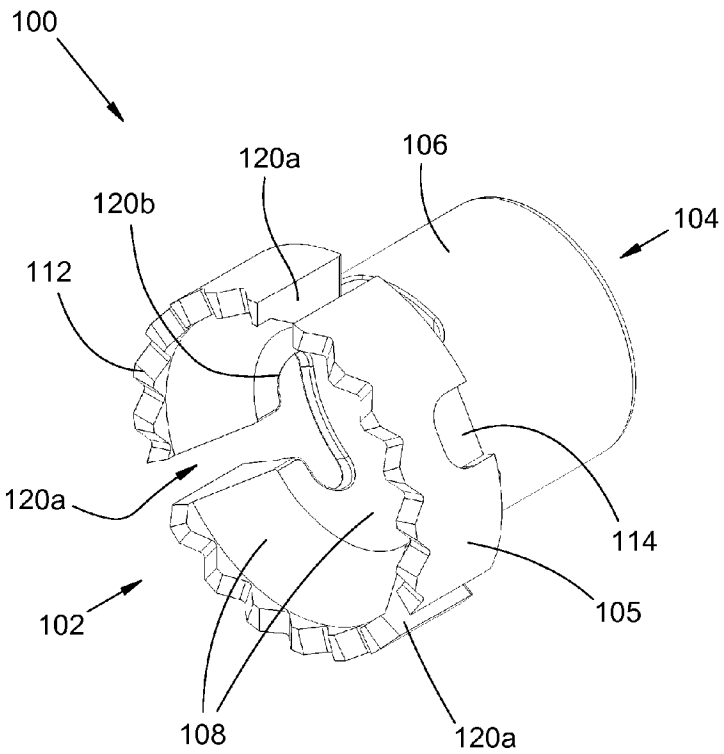

An example of an inventive termination ring 100 is shown in FIGS. 3A through 3G. The inventive termination ring 100 includes forward and rearward ends 102 and 104, an outer surface, and a central axial passage 108. In this example a rearward portion 106 of the outer surface has a diameter smaller than that of a forward portion 105 of the outer surface. The termination ring 100 is structurally arranged so as to accommodate through the central passage 108 the one or more insulated electrical wires 902 of the cable 900 and the one or more inner conductive shields 904 of the cable 900, i.e., the central passage 108 is large enough for all of the wires 902 and inner shields 904 of the cable 900 to pass through the central passage 108. The central passage 108 can be provided with any suitable cross-sectional shape or longitudinal profile for accommodating any needed or desired arrangement of the wires 902 or inner shields 904. In the example shown, the central passage 108 has a generally circular cross section and a forward portion of the central passage 108 tapers (i.e., becomes narrower) in a rearward direction, so as to accommodate routing of each of the wires 902 to its respective destination within the front connector body 802. Any other suitable cross-sectional shape or longitudinal profile can be employed; in one such example, a simple straight cylindrical central passage 108 can be employed.

The termination ring 100 is structurally adapted so as to enable non-rotatable engagement with a front connector body 802 of the connector assembly 800. In the example shown, the forward end 102 of the termination ring 100 includes a set of multiple forward-extending teeth 112 arranged so as to engage non-rotatably a mating set of rearward-extending teeth 812 of the front connector body 802. Other suitable arrangements can be employed for providing non-rotatable engagement of the termination ring 100 with the front connector body 802, e.g., any suitable combination of mating teeth, splines, grooves, cogs, tabs, slots, and so forth. The term "non-rotatable" as used herein shall include arrangements wherein only limited or constrained relative rotation, or no relative rotation, of the engaged objects might occur. For example, initial engagement of the teeth 112 and 812 still permits limited relative rotation of the termination ring 100 and the front connector body 802, but it is not until the teeth are fully engaged (i.e., "bottomed out") that relative rotation is substantially prevented. Both initial and full engagement of the teeth 112 and 812 are encompassed by the term "non-rotatable engagement."

The termination ring 100 is structurally adapted so as to enable non-rotatable engagement with a backshell assembly 804 of the connector assembly 800. In the example shown, the termination ring 100 includes a set of multiple slots 114 on its outer surface 106. The slots 114 are arranged to engage a set of mating cogs or tabs at the forward end of the backshell assembly 804. As described above, the "non-rotatable engagement" includes partial engagement or other arrangements wherein only limited relative rotation of the termination ring 100 and the backshell assembly 804 might be permitted. The termination ring 100 can be provided with any suitable set of one or more slots, cogs, tabs, splines, or grooves arranged so as to engage non-rotatably a mating set of one or more cogs, tabs, slots, grooves, or splines of the backshell assembly 804. In some examples, the backshell assembly 804 can comprise one or more conductive materials and can be structurally arranged so that, upon assembling the connector assembly 800, electrical continuity is established between the backshell assembly 804 and the conductive termination ring 100. In other examples the backshell assembly 804 can comprise one or more insulating materials and can be structurally arranged so that, upon assembling the connector assembly 800, only insulating backshell material makes contact with the termination ring.

The termination ring 100 includes one or more slots 120. Each slot 120 extends from the outer surface through the termination ring 100 into the central passage 108, and rearward from the forward end 102 of the termination ring 100. In the example shown, each slot 120 extends rearward from the forward end 102 at least to the rearward portion 106 of the outer surface. In the example shown, each of three slots 120 is arranged as a T-shaped slot with (i) a stem portion 120*a* extending rearward from the forward end 102 of the termination ring 100 and (ii) a cross portion 120*b* of the T-shaped slot extending circumferentially partly around the termination ring 100. The three slots 120 can be preferably substantially evenly spaced around the circumference of the termination ring 100. Other numbers, shapes, or arrangements of the slots 120 can be employed.

Examples of inventive assembly procedures for terminating an electrical cable 900 with an electrical connector assembly 800 incorporating the inventive termination ring 100 and clamp 190 are illustrated in FIGS. 1A through 1G and FIGS. 2A through 2G. A forward end of the cable 900 is inserted through the backshell assembly 804 and through the central passage 108 of the termination ring 100, both of which typically are moved rearward along the cable 900 and temporarily out of the way. The outer jacket of the cable 900 is stripped from its forward end, and the outer conductive shield 906 (if present) is pulled back from the forward end of the cable 900. The multiple wires 902 and inner conductive shields 904 are separated from one another at the forward end of the cable. A corresponding conductive contact (pin contacts in the example shown; socket contacts can be employed) are attached to the forward end of each one of the wires 902, and the contacts are installed into the front connector body 802.

Each inner conductive shield 904 is passed through a corresponding one of the slots 120 of the termination ring 100, preferably distributed somewhat evenly among the slots 120 and around the circumference of the termination ring 100. With the inner conductive shields 904 in the slots 120, the termination ring 100 is moved forward along the wires 902 and inner conductive shields 904 to non-rotatably engage the front connector body 802 (in the example shown, by engagement of the teeth 112 and 812). With the termination ring 100 held in that position, the inner conductive shields 904 protruding through the slots 120 are folded back onto the rearward portion 106 of the outer surface of the termination ring 100. The folded-back inner conductive shields 904 can be temporarily secured in place, e.g., by tape (such as so-called lacing tape), ties 124, ligatures, or other suitable securing means, which can be removed later (before final assembly of the connector assembly 800) or left in place as needed or desired.

The folded-back portions 904*a* of the inner conductive shields 904 are secured against the rearward portion 106 the outer surface of the termination ring 100 with the circumferential clamp 190. Any suitable circumferential clamp 190 can be employed. In the example shown, the clamp 190 comprises a tensioned band that is wrapped around the rearward portion of the termination ring 100 and the folded-back portion 904*a* of the inner conductive shields 904 and then tightened and secured with a conventional banding tool. The band typically comprises stainless steel or other suitably strong, flexible banding material. Multiple bands can be employed if needed or desired. Alternatively, a metal crimp tube can be employed as the clamp 190, and can comprise copper or other suitable metal or alloy and can be applied with a conventional crimping tool. Multiple crimp tubes can be employed if needed or desired. Whatever its specific form, the circumferential clamp 190 is structurally arranged so as to (i) at least partly encircle the rearward portion 106 of the outer surface and (ii) retain against the rearward portion 106 the folded-back portions 904*a* of the inner conductive shields 904 that extend forward from the cable 900, are received and extend forward into the central passage 108, and are folded back through a corresponding one of the slots 120 onto the rearward portion 106 of the outer surface of the termination ring 100. The clamp 190 thereby maintains mechanical and electrical contact between the conductive termination ring 100 and the inner conductive shields 904. To facilitate that engagement, the rearward portion 106 of the outer termination ring surface can include a textured surface, knurling, one or more circumferential grooves or splines, or one or more barbs; those surface features can deform the folded-back portions 904*a* of the inner conductive shields 904 as they are compressed by the clamp 190 so as to achieve more secure or intimate contact between the termination ring 100 and the inner conductive shields 904.

If the cable 900 includes an outer conductive shield 906, that shield can be pulled forward, over the folded-back portions 904*a* of the inner conductive shields 904, before the circumferential clamp 190 is deployed. The clamp 190 can be used to secure the outer conductive shield 906 against the folded-back portions 904*a* of the inner conductive shields 904 (and perhaps also partly against the rearward portion 106 of the termination ring outer surface), with the folded-back portions 904*a* of the inner conductive shields 904 between the rearward portion 106 of the termination ring outer surface and the outer conductive shield 906. A single clamp 190 compresses the outer conductive shield 906 onto the folded-back portions 904*a* of the inner conductive shields 904, and the folded-back portions 904*a* of the inner conductive shields 904 onto the rearward portion 106 of the termination ring outer surface 106. Alternatively, the folded-back portions 904*a* of the inner conductive shields 904 can be compressed onto the rearward portion 106 of the termination ring outer surface 106 by the circumferential clamp 190 as described above, and then the outer conductive shield can be pulled forward over the folded-back portions 904*a* of the inner conductive shields 904 (and optionally also over the clamp 190). A second clamp can be employed to secure the outer conductive shield 906 against the folded-back portions 904*a* of the inner conductive shields 904 (and perhaps also partly against the rearward portion 106 of the termination ring outer surface), with the folded-back portions 904*a* of the inner conductive shields 904 between the rearward portion 106 of the termination shield outer surface and the outer conductive shield 906. The second circumferential clamp can be of any suitable type, including those described above for clamp 190 (e.g., one or more tensioned bands or one or more crimp tubes). The clamp 190 and the second clamp can be, but need not be, of the same type in a given connector assembly 800. In both arrangements (i.e., a single clamp 190, or a clamp 190 with a second clamp), the outer conductive shield 906 is mechanically and electrical engaged, along with the inner conductive shields 904, to the conductive termination ring 100.

With the inner conductive shields 904 (and the outer conductive shield 906, is present) secured to the termination ring 100 and the termination ring 100 engaged with the front connector body 802, the backshell assembly 804 is moved forward along the cable 900 to non-rotatably engage the termination ring 100 (in the example shown, by engagement of the slots 114 with tabs or cogs of the backshell assembly 804). The backshell assembly 804 is then secured to the front connector body 802 in any suitable way (nut 808 engaged with threads 809 in the example shown), with the termination ring 100 between the front connector body 802 and the backshell assembly 804. Depending on the type and arrangement of the backshell assembly 804, in some examples the rearward portion of the backshell assembly 804 can be secured onto the outer jacket of the cable 900. In the example shown, the swing arm 806 is clamped onto the outer jacket of the cable 900. The diameter of the rearward portion 106 of the outer surface of the termination ring 100 is sufficiently small so that, upon assembling the connector assembly 800, a void 801 remains between (i) an interior lateral surface of the backshell assembly 804 (the interior lateral surface 805*a* of the backshell body 805 in the example shown) and (ii) the folded-back portions 904*a* of the inner conductive shields 904 retained by the clamp 190 against the rearward portion 106 of the termination shield outer surface. The reduced-diameter portion 106 of the inventive termination ring 100 can enable it to be substituted into a connector assembly 800 having an original termination ring or backshell assembly 804 not necessarily designed to accommodate termination of the inner conductive shields 904. Such a retrofit can enable improvement of the inner shield termination in connectors already deployed, or to upgrade existing connector assemblies or backshell assemblies not yet deployed.

In alternative inventive arrangements, the termination ring need not have a rearward portion of its outer surface with a reduced diameter relative to the forward portion. Instead, the termination ring, the backshell assembly, or both, can be structurally arranged in any suitable or desirable way so that, upon assembly, a void remains between (i) the interior lateral surface of the backshell assembly and (ii) the folded-back portions of the inner conductive shields retained by the clamp against the rearward portion of the outer surface of the termination ring. In one such example, a termination ring having a single-diameter cylindrical outer surface can be employed, and the corresponding backshell assembly can have an enlarged portion of its central passage to provide the void.

The arrangement of the inventive termination ring 100 and circumferential clamp 190 offers several advantages over connector assemblies employing conventional termination rings. For example, the termination ring of U.S. Pat. No. 6,419,519 (cited above) does not allow multiple inner conductive shields to be readily connected to the termination ring. In contrast, the termination ring of U.S. Pat. No. 6,276,967 enables termination of multiple inner conductive shields in a slotted termination ring. However, in that example, electrical and mechanical engagement of the inner conductive shields is maintained by compression of the inner conductive shields against the termination ring by the backshell assembly, which effectively prevents positive, predictable mechanical engagement of the backshell assembly with the termination ring or with the front connector body, because the number and, particularly, the placement and arrangement of the inner conductive shields will vary from connector to connector. Asymmetry of the arrangement of the inner conductive shields can be particularly troublesome, by misaligning the backshell assembly relative to the termination ring or the front connector body. The variation of number, placement or arrangement of the inner conductive shields therefore interferes with the mechanical engagement of the substantially rigid backshell assembly with the substantially rigid termination ring or front connector body.

Use of a tensioned band or a crimp tube for the clamp 190, however, can accommodate differing numbers or arrangements of the folded-back portions 904*a* of the inner conductive shields 904. Typical banding and crimp tools can be set to apply a preset level of tension (for banding) or pressure (for crimping) regardless of the final position of the tool, allowing the tools (and therefore the deployed clamp 190) to accommodate differing numbers, positions, or arrangements of the inner conductive shells 904. The flexibility or deformability enables the band or crimp tube to conform to whatever arrangement of inner conductive shields appears on the termination ring, even if the arrangement is asymmetric. Using the inventive combination of the termination ring 100 and the circumferential clamp 190, a void 801 remains between (i) an interior lateral surface of the backshell assembly and (ii) the folded-back portions 904*a* of the inner conductive shields 904 retained by the clamp 190 against the rearward portion 106 of the termination shield outer surface. The void 801 allows the front connector body 802, and backshell assembly 804, and the termination ring 100 to achieve fully aligned full mechanical engagement without interference from the inner conductive shields 904 (or the outer conductive shield 906, if present) that are connected to the termination ring 100.

A further advantage offered by the inventive methods disclosed herein is the ability to disassemble, then alter or repair, and then reassemble the connector assembly 800 without damaging the inner conductive shields 904 or their attachment or connection to the termination ring. In the connector assembly of U.S. Pat. No. 6,276,967, for example, electrical and mechanical engagement of the inner conductive shields is maintained by compression of the inner conductive shields against the termination ring by the backshell assembly. That compression typically deforms or even damages the inner conductive shields, which is typically inconsequential as long as the connector assembly remains assembled. After disassembly, however, that damage or deformation often prevents, or at least inhibits, reestablishing the engagement and connection of the inner conductive shields with the termination ring.

With the disclosed inventive arrangements of the termination shield 100, the clamp 190, the backshell assembly 804, and the inner conductive shields 904, the connector assembly can be disassembled (by disengaging the backshell assembly 804 from the front connector body 802) without disturbing the attachment or connection of the inner conductive shields 904 to the termination ring 100. The clamp 190 maintains the connection and attachment, while the existence of the void 801 ensures that disengagement and rearward movement of the backshell assembly 804 has no substantial effect on the connection or attachment between the termination ring 100 and the inner conductive shields 904. After releasing the backshell assembly 804 from the front connector body 802 and moving it rearward along the cable 900, one or more among the wires 902, the corresponding conductive contacts, the inner conductive shields 904, or other parts or components of the electrical connector assembly 800 can be disconnected, repaired, replaced, or reconnected as needed or desired to effect a desired repair or alteration of the connector assembly 800. Afterward, the backshell assembly 804 is moved forward along the cable 900 and re-engaged with and re-secured to the front connector body 802. After reassembly, the void 801 remains between the interior lateral surface of the backshell assembly 802 and the folded-back portions 904*a* of the inner conductive shields 904 retained by the clamp 190 against the rearward portion 106 of the outer surface of the termination ring 100. If required for whatever repair or alteration is needed or desired, the termination ring 100 can be moved rearward along the wires 902 and inner shields 904 to enable the repair or alteration and then moved forward again to re-engage the from connector body 802. The inventive methods enable some repairs or alterations to be made without disconnecting or detaching any of the inner conductive shields 904 from the termination ring.

In addition to the preceding, the following examples fall within the scope of the present disclosure or appended claims:

Example 1

A method for terminating an electrical cable with an electrical connector assembly including a termination ring and a clamp, the method comprising: (A) inserting a forward end of the cable through a backshell assembly of the connector assembly and through a central passage of the termination ring; (B) stripping an outer jacket of the cable from a forward end of the cable, separating one or more wires and one or more inner conductive shields from one another at the forward end of the cable, and attaching a corresponding conductive contact to a corresponding forward end of each one of the one or more wires; (C) installing the corresponding contacts into a front connector body of the connector assembly; (D) passing each one of the one or more inner conductive shields through a corresponding one of one or more slots of the termination ring, moving the termination ring forward along the one or more wires and the one or more inner conductive shields to non-rotatably engage the front connector body, and folding the one or more inner conductive shields back onto a rearward portion of an outer surface of the termination ring, wherein each one of the one or more slots extends from the outer surface through the termination ring to the central passage and extends rearward from a forward end of the termination ring; (E) securing against the outer surface, with the clamp, the folded-back portions of the one or more inner conductive shields; and (F) moving the backshell assembly forward along the cable to non-rotatably engage the termination ring and securing the backshell assembly to the front connector body with the termination ring therebetween, a void remaining between (i) an interior lateral surface of the backshell assembly and (ii) the folded-back portions of the inner conductive shields retained by the clamp against the rearward portion of the outer surface.

Example 2

The method of Example 1 wherein the rearward portion of the outer surface of the termination ring has a diameter smaller than a diameter of a forward portion of the outer surface, and each one of the one or more slots extends rearward at least to the rearward portion of the outer surface.

Example 3

The method of any one of Examples 1 or 2 further comprising: (i) during part (B), pulling an outer conductive shield back from a forward end of the cable; (ii) before part (E), pulling the outer conductive shield forward over the folded-back portions of the one or more inner conductive shields; and (iii) during part (E), securing the outer conductive shield, with the clamp, against the rearward portion of the outer surface or against the folded-back portions of the one or more inner conductive shields, with the folded-back portions of the one or more inner conductive shields between the rearward portion of the outer surface and the outer conductive shield.

Example 4

The method of any one of Examples 1 or 2 further comprising: (i) during part (B), pulling an outer conductive shield back from a forward end of the cable; and (ii) after part (E) and before part (F), pulling the outer conductive shield forward over the folded-back portions of the one or more inner conductive shields and the clamp and securing, with a second clamp, the outer conductive shield against the rearward portion of the outer surface or against the folded-back portions of the one or more inner conductive shields, with the folded-back portions of the one or more inner conductive shields between the rearward portion of the outer surface and the outer conductive shield.

Example 5

The method of Example 4 wherein the second clamp comprises at least one tensioned band.

Example 6

The method of Example 4 wherein the second clamp comprises at least one crimp tube.

Example 7

The method of any one of Examples 1 through 6 further comprising, after part (F): (G) releasing the backshell assembly from the front connector body and moving the backshell assembly rearward along the cable; (H) disconnecting, repairing, replacing, or reconnecting one or more among (i) the one or more wires, (ii) the corresponding conductive contacts, or (iii) the one or more inner conductive shields; and (I) moving the backshell assembly forward along the cable to non-rotatably engage the termination ring and re-securing the backshell assembly to the front connector body with the termination ring therebetween, the void remaining between (i) the interior lateral surface of the backshell assembly and (ii) the folded-back portions of the inner conductive shields retained by the clamp against the rearward portion of the outer surface.

Example 8

The method of Example 7 further comprising: (J) after part (G) and before part (H), moving the termination ring rearward along the one or more wires and the one or more inner conductive shields; and (K) after part (H) and before part (I), moving the termination ring forward along the one or more wires and the one or more inner conductive shields to non-rotatably engage the front connector body.

Example 9

The method of any one of Examples 7 or 8 wherein the method is performed without disconnecting or detaching any of the one or more inner conductive shields from the termination ring.

Example 10

The method of any one of Examples 1 through 9 wherein the clamp comprises at least one tensioned band.

Example 11

The method of any one of Examples 1 through 9 wherein the clamp comprises at least one crimp tube.

Example 12

The method of any one of Examples 1 through 11 wherein each one of the one or more slots is arranged as a T-shaped slot with a stem portion of the T-shaped slot extending rearward from the forward end of the termination ring and a cross portion of the T-shaped slot extending circumferentially partly around the termination ring.

Example 13

The method of any one of Examples 1 through 12 wherein at least a portion of the central passage tapers in a rearward direction.

Example 14

The method of any one of Examples 1 through 13 wherein the forward end of the termination ring includes a set of multiple forward-extending teeth arranged so as to engage non-rotatably a mating set of rearward-extending teeth of the front connector body.

Example 15

The method of any one of Examples 1 through 14 wherein the outer surface includes a set of one or more slots, tabs, splines, or grooves arranged so as to engage non-rotatably a mating set of one or more tabs, slots, grooves, or splines of the backshell assembly.

Example 16

The method of any one of Examples 1 through 15 wherein the rearward portion of the outer surface includes a textured surface, knurling, one or more circumferential grooves or splines, or one or more barbs, so as to facilitate mechanical and electrical engagement of the termination ring with the folded-back portions of the one or more inner conductive shields.

Example 17

The method of any one of Examples 1 through 16 further comprising securing a rearward portion of the backshell assembly onto the outer jacket of the cable.

Example 18

The method of any one of Examples 1 through 17 wherein the backshell assembly includes one or more electrically insulating backshell materials and is structurally arranged so that, upon assembling the connector assembly, only insulating backshell material makes contact with the termination ring.

Example 19

An article comprising an electrically conductive termination ring and a circumferential clamp for an electrical connector assembly on an electrical cable, wherein: (a) the termination ring includes forward and rearward ends, an outer surface with a rearward portion thereof having a diameter smaller than that of a forward portion thereof, and a central axial passage, and is structurally arranged so as to (i) accommodate through the central passage one or more insulated electrical wires of the cable and one or more inner conductive shields of the cable and (ii) enable non-rotatable engagement with a front connector body of the connector assembly and with a backshell assembly of the connector assembly; (b) the termination ring includes one or more slots, each slot extends from the outer surface through the termination ring into the central passage, and each slot extends from the forward end of the termination ring rearward at least to the rearward portion of the outer surface; (c) the circumferential clamp is structurally arranged so as to (i) at least partly encircle the rearward portion of the outer surface and (ii) retain against the rearward portion of the outer surface folded-back portions of the one or more inner conductive shields that extend forward from the cable, are received and extend forward into the central passage, and are folded back through a corresponding one of the one or more slots onto the rearward portion of the outer surface; and (d) the diameter of the rearward portion of the outer surface is sufficiently small so that, upon assembling the connector assembly, a void remains between (i) an interior lateral surface of the backshell assembly and (ii) the folded-back portions of the inner conductive shields retained by the clamp against the rearward portion of the outer surface.

Example 20

An article comprising an electrically conductive termination ring, a circumferential clamp, and a backshell assembly for an electrical connector assembly on an electrical cable, wherein: (a) the termination ring includes forward and rearward ends and a central axial passage and is structurally arranged so as to (i) accommodate through the central passage one or more insulated electrical wires of the cable and one or more inner conductive shields of the cable and (ii) enable non-rotatable engagement with a front connector body of the connector assembly and with the backshell assembly; (b) the termination ring includes one or more slots, each slot extends from the outer surface through the termination ring into the central passage, and each slot extends rearward from the forward end of the termination ring; (c) the circumferential clamp is structurally arranged so as to (i) at least partly encircle the rearward portion of the outer surface and (ii) retain against the rearward portion of the outer surface folded-back portions of the one or more inner conductive shields that extend forward from the cable, are received and extend forward into the central passage, and are folded back through a corresponding one of the one or more slots onto the rearward portion of the outer surface; and (d) the rearward portion of the outer surface of the termination ring and the backshell assembly are structurally arranged so that, upon assembling the connector assembly, a void remains between (i) an interior lateral surface of the backshell assembly and (ii) the folded-back portions of the inner conductive shields retained by the clamp against the rearward portion of the outer surface.

Example 21

The article of Example 20 wherein the rearward portion of the outer surface of the termination ring has a diameter smaller than a diameter of a forward portion of the outer surface, and each one of the one or more slots extends rearward at least to the rearward portion of the outer surface.

Example 22

The article of any one of Examples 19 through 21 wherein the circumferential clamp is further structurally arranged so as to retain against the rearward portion of the outer surface, or against the folded-back portions of the one or more inner conductive shields, a forward portion of a cable outer conductive shield extending forward from the cable around the rearward portion of the outer surface, with the folded-back portions of the one or more inner conductive shields between the rearward portion of the outer surface and the outer conductive shield.

Example 23

The article of any one of Examples 19 through 21 further comprising a second circumferential clamp structurally arranged so as to retain against the rearward portion of the outer surface, or against the folded-back portions of the one or more inner conductive shields, a forward portion of a cable outer conductive shield extending forward from the cable around the rearward portion of the outer surface, with the clamped, folded-back portions of the one or more inner conductive shields between the rearward portion of the outer surface and the outer conductive shield.

Example 24

The article of Example 23 wherein the second clamp comprises at least one tensioned band.

Example 25

The article of Example 23 wherein the second clamp comprises at least one crimp tube.

Example 26

The article of any one of Examples 19 through 25 wherein the clamp comprises at least one tensioned band.

Example 27

The article of any one of Examples 19 through 25 wherein the clamp comprises at least one crimp tube.

Example 28

The article of any one of Examples 19 through 27 wherein each one of the one or more slots is arranged as a T-shaped slot with a stem portion of the T-shaped slot extending rearward from the forward end of the termination ring and a cross portion of the T-shaped slot extending circumferentially partly around the termination ring.

Example 29

The article of any one of Examples 19 through 28 wherein at least a portion of the central passage tapers in a rearward direction.

Example 30

The article of any one of Examples 19 through 29 wherein the forward end of the termination ring includes a set of multiple forward-extending teeth arranged so as to engage non-rotatably a mating set of rearward-extending teeth of the front connector body.

Example 31

The article of any one of Examples 19 through 30 wherein the outer surface includes a set of one or more slots, tabs, splines, or grooves arranged so as to engage non-rotatably a mating set of one or more tabs, slots, grooves, or splines of the backshell assembly.

Example 32

The article of any one of Examples 19 through 31 wherein the rearward portion of the outer surface includes a textured surface, knurling, one or more circumferential grooves or splines, or one or more barbs, so as to facilitate mechanical and electrical engagement of the termination ring with the folded-back portions of the one or more inner conductive shields.

Example 33

The article of any one of Examples 20 through 32 wherein the backshell assembly is structurally arranged so as to enable securing a rearward portion of the backshell assembly onto the outer jacket of the cable.

Example 34

The article of any one of Examples 20 through 33 wherein the backshell assembly includes one or more electrically insulating backshell materials and is structurally arranged so that, upon assembling the connector assembly, only insulating backshell material makes contact with the termination ring.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise.

In the appended claims, if the provisions of 35 USC §112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An article comprising an electrically conductive termination ring and a circumferential clamp for an electrical connector assembly on an electrical cable, wherein:

(a) the termination ring includes forward and rearward ends, an outer surface with a rearward portion thereof having a diameter smaller than that of a forward portion thereof, and a central axial passage, and is structurally arranged so as to (i) accommodate through the central passage one or more insulated electrical wires of the cable and one or more inner conductive shields of the cable and (ii) enable non-rotatable engagement with a front connector body of the connector assembly and with a backshell assembly of the connector assembly;

(b) the termination ring includes one or more slots, each slot extends from the outer surface through the termination ring into the central passage, and each slot extends from the forward end of the termination ring rearward at least to the rearward portion of the outer surface;

(c) the circumferential clamp is structurally arranged so as to (i) at least partly encircle the rearward portion of the outer surface and (ii) retain against the rearward portion of the outer surface folded-back portions of the one or more inner conductive shields that extend forward from the cable, are received and extend forward into the central passage, and are folded back through a corresponding one of the one or more slots onto the rearward portion of the outer surface; and (d) the diameter of the rearward portion of the outer surface is sufficiently small so that, upon assembling the connector assembly, a void remains between (i) an interior lateral surface of the backshell assembly and (ii) the folded-back portions of the inner conductive shields retained by the clamp against the rearward portion of the outer surface.

2. An article comprising an electrically conductive termination ring, a circumferential clamp, and a backshell assembly for an electrical connector assembly on an electrical cable, wherein:

(a) the termination ring includes forward and rearward ends and a central axial passage and is structurally arranged so as to (i) accommodate through the central passage one or more insulated electrical wires of the cable and one or more inner conductive shields of the cable and (ii) enable non-rotatable engagement with a front connector body of the connector assembly and with the backshell assembly;

(b) the termination ring includes one or more slots, each slot extends from the outer surface through the termination ring into the central passage, and each slot extends rearward from the forward end of the termination ring;

(c) the circumferential clamp is structurally arranged so as to (i) at least partly encircle the rearward portion of the outer surface and (ii) retain against the rearward portion of the outer surface folded-back portions of the one or more inner conductive shields that extend forward from the cable, are received and extend forward into the central passage, and are folded back through a corresponding one of the one or more slots onto the rearward portion of the outer surface; and (d) the rearward portion of the outer surface of the termination ring and the backshell assembly are structurally arranged so that, upon assembling the connector assembly, a void remains between (i) an interior lateral surface of the backshell assembly and (ii) the folded-back portions of the inner conductive shields retained by the clamp against the rearward portion of the outer surface.

3. The article of claim 2 wherein the rearward portion of the outer surface of the termination ring has a diameter smaller than a diameter of a forward portion of the outer surface, and each one of the one or more slots extends rearward at least to the rearward portion of the outer surface.

4. The article of claim 2 wherein the circumferential clamp is further structurally arranged so as to retain against the rearward portion of the outer surface, or against the folded-back portions of the one or more inner conductive shields, a forward portion of a cable outer conductive shield extending forward from the cable around the rearward portion of the outer surface, with the folded-back portions of the one or more inner conductive shields between the rearward portion of the outer surface and the outer conductive shield.

5. The article of claim 2 further comprising a second circumferential clamp structurally arranged so as to retain against the rearward portion of the outer surface, or against the folded-back portions of the one or more inner conductive shields, a forward portion of a cable outer conductive shield extending forward from the cable around the rearward portion of the outer surface, with the clamped, folded-back portions of the one or more inner conductive shields between the rearward portion of the outer surface and the outer conductive shield.

6. The article of claim 5 wherein the second clamp comprises at least one tensioned band.

7. The article of claim 5 wherein the second clamp comprises at least one crimp tube.

8. The article of claim 2 wherein the clamp comprises at least one tensioned band.

9. The article of claim 2 wherein the clamp comprises at least one crimp tube.

10. The article of claim 2 wherein each one of the one or more slots is arranged as a T-shaped slot with a stem portion of the T-shaped slot extending rearward from the forward end of the termination ring and a cross portion of the T-shaped slot extending circumferentially partly around the termination ring.

11. The article of claim 2 wherein at least a portion of the central passage tapers in a rearward direction.

12. The article of claim 2 wherein the forward end of the termination ring includes a set of multiple forward-extending teeth arranged so as to engage non-rotatably a mating set of rearward-extending teeth of the front connector body.

13. The article of claim 2 wherein the outer surface includes a set of one or more slots, tabs, splines, or grooves arranged so as to engage non-rotatably a mating set of one or more tabs, slots, grooves, or splines of the backshell assembly.

14. The article of claim 2 wherein the rearward portion of the outer surface includes a textured surface, knurling, one or more circumferential grooves or splines, or one or more barbs, so as to facilitate mechanical and electrical engagement of the termination ring with the folded-back portions of the one or more inner conductive shields.

15. The article of claim 2 wherein the backshell assembly is structurally arranged so as to enable securing a rearward portion of the backshell assembly onto the outer jacket of the cable.

16. The article of claim 2 wherein the backshell assembly includes one or more electrically insulating backshell materials and is structurally arranged so that, upon assembling the connector assembly, only insulating backshell material makes contact with the termination ring.

17. A method for terminating an electrical cable with an electrical connector assembly including an electrically conductive termination ring, a circumferential clamp, and a backshell assembly, wherein:

(a) the termination ring includes forward and rearward ends and a central axial passage and is structurally arranged so as to (i) accommodate through the central passage one or more insulated electrical wires of the cable and one or more inner conductive shields of the cable and (ii) enable non-rotatable engagement with a front connector body of the connector assembly and with the backshell assembly;

(b) the termination ring includes one or more slots, each slot extends from the outer surface through the termination ring into the central passage, and each slot extends rearward from the forward end of the termination ring;

(c) the circumferential clamp is structurally arranged so as to (i) at least partly encircle the rearward portion of the outer surface and (ii) retain against the rearward portion of the outer surface folded-back portions of the one or more inner conductive shields that extend forward from the cable, are received and extend forward into the central passage, and are folded back through a corresponding one of the one or more slots onto the rearward portion of the outer surface; and (d) the rearward portion of the outer surface of the termination ring and the backshell assembly are structurally arranged so that, upon assembling the connector assembly, a void remains between (i) an interior lateral surface of the backshell assembly and (ii) the folded-back portions of the inner conductive shields retained by the clamp against the rearward portion of the outer surface, and wherein the method comprises:

(A) inserting a forward end of the cable through the backshell assembly of the connector assembly and through the central passage of the termination ring;

(B) stripping an outer jacket of the cable from the forward end of the cable, separating one or more wires and one or more inner conductive shields from one another at the forward end of the cable, and attaching a corresponding conductive contact to a corresponding forward end of each one of the one or more wires;

(C) installing the corresponding contacts into the front connector body of the connector assembly;

(D) passing each one of the one or more inner conductive shields through a corresponding one of one or more slots of the termination ring, moving the termination ring forward along the one or more wires and the one or more inner conductive shields to non-rotatably engage the front connector body, and folding the one or more inner conductive shields back onto the rearward portion of the outer surface of the termination ring;

(E) securing against the outer surface, with the clamp, the folded-back portions of the one or more inner conductive shields; and (F) moving the backshell assembly forward along the cable to non-rotatably engage the termination ring and securing the backshell assembly to the front connector body with the termination ring therebetween, a void remaining between (i) the interior lateral surface of the backshell assembly and (ii) the folded-back portions of the inner conductive shields retained by the clamp against the rearward portion of the outer surface.

18. The method of claim 17 wherein the rearward portion of the outer surface of the termination ring has a diameter smaller than a diameter of a forward portion of the outer surface, and each one of the one or more slots extends rearward at least to the rearward portion of the outer surface.

19. The method of claim 17 further comprising: (i) during part (B), pulling an outer conductive shield back from a forward end of the cable; (ii) before part (E), pulling the outer conductive shield forward over the folded-back portions of the one or more inner conductive shields; and (iii) during part (E), securing the outer conductive shield, with the clamp, against the rearward portion of the outer surface or against the folded-back portions of the one or more inner conductive shields, with the folded-back portions of the one or more inner conductive shields between the rearward portion of the outer surface and the outer conductive shield.

20. The method of claim 17 further comprising: (i) during part (B), pulling an outer conductive shield back from a forward end of the cable; and (ii) after part (E) and before part (F), pulling the outer conductive shield forward over the folded-back portions of the one or more inner conductive shields and the clamp and securing, with a second clamp, the outer conductive shield against the rearward portion of the outer surface or against the folded-back portions of the one or more inner conductive shields, with the folded-back portions of the one or more inner conductive shields between the rearward portion of the outer surface and the outer conductive shield.

21. The method of claim 20 wherein the second clamp comprises at least one tensioned band.

22. The method of claim 20 wherein the second clamp comprises at least one crimp tube.

23. The method of claim 17 further comprising, after part (F):

(G) releasing the backshell assembly from the front connector body and moving the backshell assembly rearward along the cable;

(H) disconnecting, repairing, replacing, or reconnecting one or more among (i) the one or more wires, (ii) the corresponding conductive contacts, or (iii) the one or more inner conductive shields; and (I) moving the backshell assembly forward along the cable to non-rotatably engage the termination ring and re-securing the backshell assembly to the front connector body with the termination ring therebetween, the void remaining between (i) the interior lateral surface of the backshell assembly and (ii) the folded-back portions of the inner conductive shields retained by the clamp against the rearward portion of the outer surface.

24. The method of claim 23 further comprising:

(J) after part (G) and before part (H), moving the termination ring rearward along the one or more wires and the one or more inner conductive shields; and (K) after part (H) and before part (I), moving the termination ring forward along the one or more wires and the one or more inner conductive shields to non-rotatably engage the front connector body.

25. The method of claim 23 wherein the method is performed without disconnecting or detaching any of the one or more inner conductive shields from the termination ring.

26. The method of claim 17 wherein the clamp comprises at least one tensioned band.

27. The method of claim 17 wherein the clamp comprises at least one crimp tube.

28. The method of claim 17 wherein each one of the one or more slots is arranged as a T-shaped slot with a stem portion of the T-shaped slot extending rearward from the forward end of the termination ring and a cross portion of the T-shaped slot extending circumferentially partly around the termination ring.

29. The method of claim 17 wherein at least a portion of the central passage tapers in a rearward direction.

30. The method of claim 17 wherein the forward end of the termination ring includes a set of multiple forward-extending teeth arranged so as to engage non-rotatably a mating set of rearward-extending teeth of the front connector body.

31. The method of claim 17 wherein the outer surface includes a set of one or more slots, tabs, splines, or grooves arranged so as to engage non-rotatably a mating set of one or more tabs, slots, grooves, or splines of the backshell assembly.

32. The method of claim 17 wherein the rearward portion of the outer surface includes a textured surface, knurling, one or more circumferential grooves or splines, or one or more barbs, so as to facilitate mechanical and electrical engagement of the termination ring with the folded-back portions of the one or more inner conductive shields.

33. The method of claim 17 further comprising securing a rearward portion of the backshell assembly onto the outer jacket of the cable.

34. The method of claim 17 wherein the backshell assembly includes one or more electrically insulating backshell materials and is structurally arranged so that, upon assembling the connector assembly, only insulating backshell material makes contact with the termination ring.

* * * * *